US008653739B2

(12) United States Patent
Zimmermann et al.

(10) Patent No.: US 8,653,739 B2
(45) Date of Patent: Feb. 18, 2014

(54) CIRCUIT FOR OPERATING LIGHT EMITTING DIODES (LEDS)

(75) Inventors: Michael Zimmermann, Helligkreuz (CH); Eduardo Pereira, Siebnen (CH)

(73) Assignee: TridonicAtco Schweiz AG, Ennenda (CH)

( * ) Notice: Subject to any disclaimer, the term of this patent is extended or adjusted under 35 U.S.C. 154(b) by 804 days.

(21) Appl. No.: 12/646,138

(22) Filed: Dec. 23, 2009

(65) Prior Publication Data

US 2010/0148683 A1 Jun. 17, 2010

Related U.S. Application Data

(63) Continuation-in-part of application No. PCT/EP2008/005367, filed on Jul. 1, 2008.

(30) Foreign Application Priority Data

Jul. 4, 2007 (DE) ..... 10 2007 031 038

(51) Int. Cl.
*H05B 37/02* (2006.01)

(52) U.S. Cl.
USPC ..... 315/209 R; 315/224; 315/291

(58) Field of Classification Search
USPC ..... 315/224, 291, 307, 294, 297, 312, 315/209 R, 225, 308
See application file for complete search history.

(56) References Cited

U.S. PATENT DOCUMENTS

| | | | | |
|---|---|---|---|---|
| 6,329,764 | B1 | 12/2001 | Van de Ven | 315/291 |
| 7,102,339 | B1 * | 9/2006 | Ferguson | 323/282 |
| 7,276,861 | B1 * | 10/2007 | Shteynberg et al. | 315/291 |
| 7,649,325 | B2 * | 1/2010 | McIntosh et al. | 315/291 |
| 7,852,017 | B1 * | 12/2010 | Melanson | 315/291 |
| 2001/0024112 | A1 | 9/2001 | Jacobs et al. | 323/282 |
| 2002/0070914 | A1 | 6/2002 | Bruning et al. | 345/102 |
| 2004/0135522 | A1 | 7/2004 | Berman et al. | 315/291 |
| 2004/0135524 | A1 | 7/2004 | Gunter et al. | 315/291 |
| 2006/0002110 | A1 * | 1/2006 | Dowling et al. | 362/252 |
| 2006/0290710 | A1 * | 12/2006 | Zwanenburg | 345/594 |
| 2007/0001620 | A1 | 1/2007 | Lee et al. | 315/247 |
| 2007/0115248 | A1 * | 5/2007 | Roberts et al. | 345/102 |
| 2009/0079362 | A1 * | 3/2009 | Shteynberg et al. | 315/294 |

FOREIGN PATENT DOCUMENTS

| | | |
|---|---|---|
| DE | 601 20 563 T2 | 5/2007 |
| WO | WO 01/80603 A2 | 10/2001 |

OTHER PUBLICATIONS

International Search Report for PCT/EP2008/005367mailed Nov. 21, 2008.

* cited by examiner

*Primary Examiner* — Jimmy Vu
(74) *Attorney, Agent, or Firm* — Winston & Strawn LLP

(57) ABSTRACT

An improved control circuit arrangement and control method is described for supplying power to, and for controlling, light-emitting diodes used for illuminating. The control circuit arrangement includes a driver circuit capable of operating in multiple modes for providing an operating current for operating at least one light-emitting diode, wherein the operating current has different positive intensities. In particular, the present control circuit arrangement and control method now deliberately exploit the fact that the color spectrum of a light emitting diode is dependent on the intensity or current with which it is operated, and improves the color rendering index by deliberately operating the light emitting diodes with different intensities over time.

18 Claims, 11 Drawing Sheets

CIRCUIT FOR OPERATING LIGHT EMITTING DIODES (LEDS)

CROSS-REFERENCE TO RELATED APPLICATIONS

This application is a continuation-in-part of International Application PCT/EP2008/005367 filed Jul. 1, 2008, the entire content of which is expressly incorporated herein by reference thereto.

BACKGROUND

The present invention relates to a circuit arrangement for operating light emitting diodes and to a method for achieving this purpose.

Figure 1:
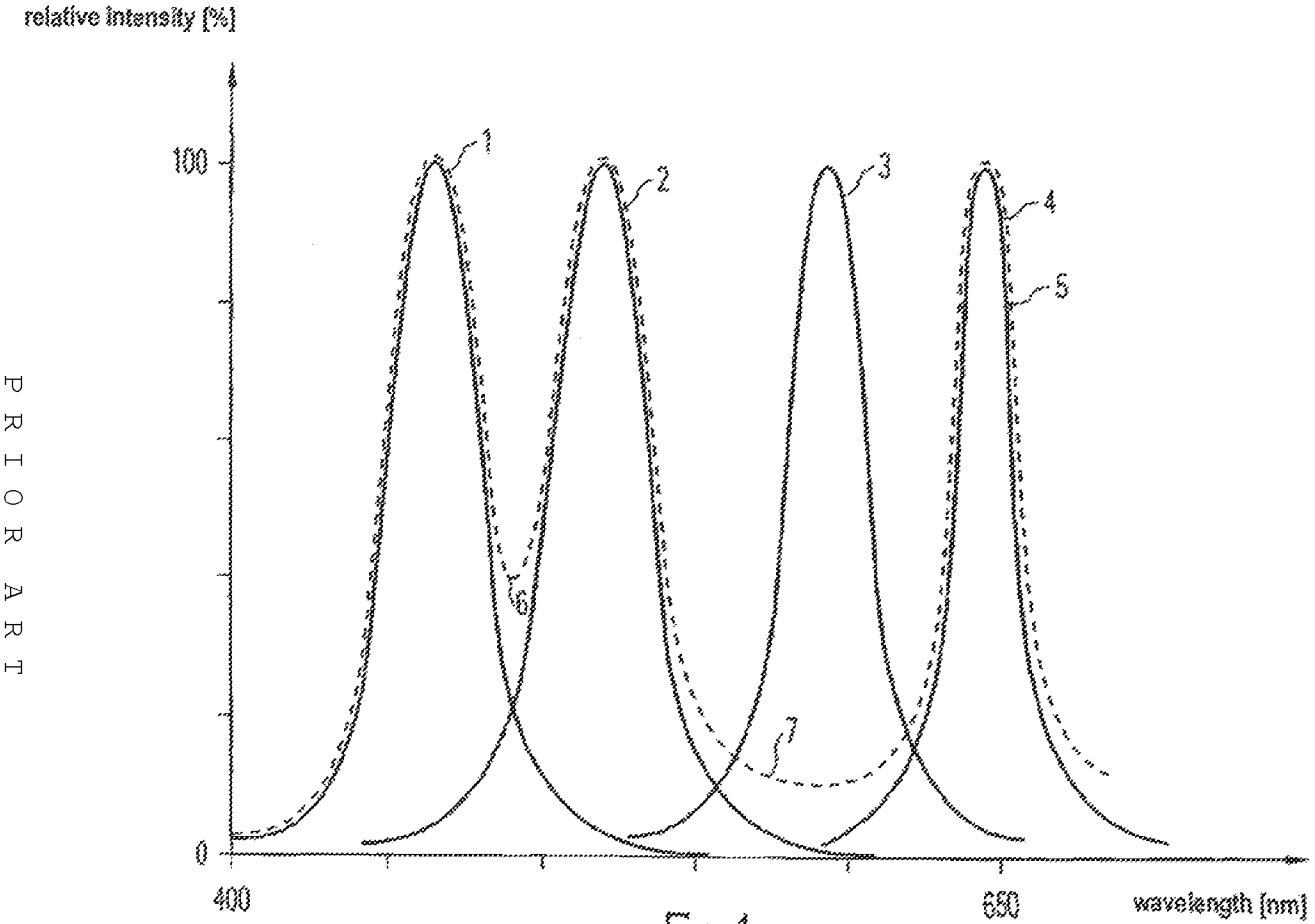
Fig. 1 PRIOR ART

Conventional light emitting diodes (LEDs) emit light within a limited spectral range. FIG. 1 shows, for example, spectra of a blue 1, green 2, yellow 3 and red 4 light emitting diode. Modules are known in which light emitting diodes of different colors, e.g. blue and yellow (two LEDs) or red, green and blue (RGB) are combined in such a way that their light is mixed, for example, by means of a diffusion screen and that the mixed light appears white or that the spectrum 5 of the light resulting therefrom extends over the whole visible range.

Although this light appears fundamentally "white" there are troughs 6, 7 within the spectrum of this emitted light. These troughs have a disadvantageous effect in that, for example, objects with colors in the range of these gaps are rendered with a very matt appearance. The quality of the color rendering, which is expressed using the color rendering index or CRI photometric variable, is accordingly dependent on these gaps.

The color rendering index expresses how close the color rendering of an artificial lighting means comes to the broadly distributed continuous spectrum of natural sunlight. As is generally known, this cannot be expressed solely by the color temperature because the color temperature does not indicate whether there may be gaps in the spectrum of an artificial lighting means.

These spectral gaps thus arise when RGB light emitting diodes are connected to each other. However, these troughs are also found when so-called white light emitting diodes are used. These are light emitting diodes which are combined with photoluminescent material (fluorescence stain, luminescent material). The light from the LED chip in a first spectrum is partially converted into a second spectrum by the phosphorous layer or color conversion layer formed thereby. The mixture of the first and second spectrum then produces the spectrum of white light.

Figure 2:
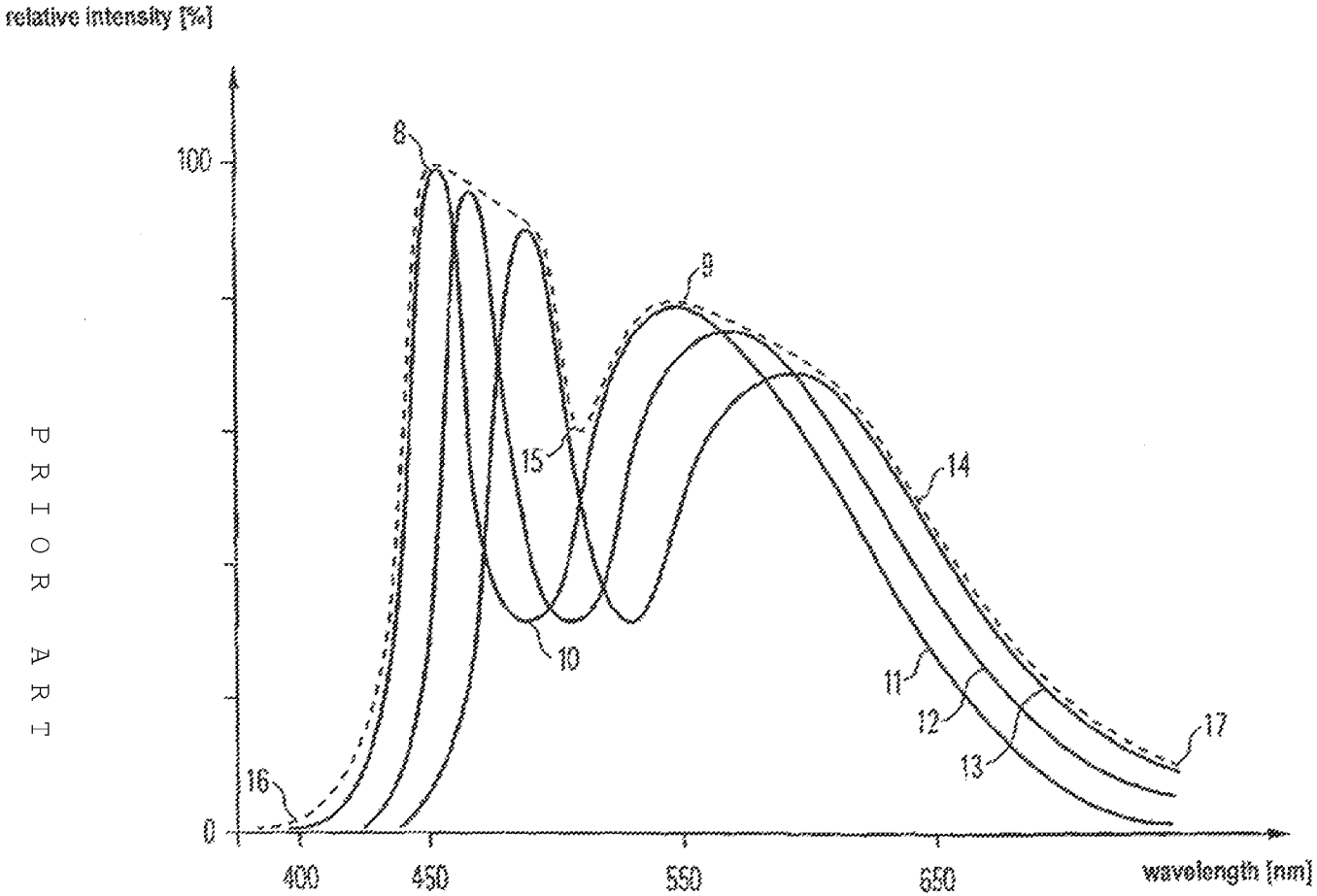
Fig. 2 PRIOR ART

FIG. 2 shows the spectrum of such a white light emitting diode. With the aid of a color conversion layer, shortwave light such as, for example, blue light 8 can be converted into longwave light, for example, in the yellow or red wavelength range 9.

However, between the actual (e.g. blue) spectrum 8 of the lighting means chip and the second (yellow or red) shifted spectrum 9 of the conversion layer there is also conventionally a spectral gap or at least a spectral trough 10 so that the quality of the color rendering or the color rendering index is reduced as a result. Thus, there is a need for improvements in the art for these type devices.

SUMMARY OF THE INVENTION

The present invention now provides an improved control circuit and control method for operating light emitting diodes.

In particular, the present invention now deliberately exploits the fact that the colour spectrum of a light emitting diode is dependent on the intensity or current with which it is operated. The invention now improves the colour rendering index CRI in that the gaps are somewhat reduced because the light emitting diode is deliberately operated with different intensity over time.

Operation with different intensity leads to the spectrum being temporally smeared so to speak, given the resolution capability of the human eye, and this, when averaged over time, improves the colour rendering index CRI.

The change in the intensity is preferably more rapid than the temporal resolution capability of the eye (e.g. over 100 Hz), as is also known in the case of pulse width-modulated light emitting diodes. In contrast to PWM in which only the level high or zero is used for the intensity of the lighting means, in accordance with the invention at least one further positive (i.e., non-zero) intensity value is used.

A first aspect of the invention relates to a driving circuit for provision of an operating current for at least one lighting means, such as e.g. a light emitting diode, the driving circuit comprising a switched converter having a switch controlled by a control circuitry, wherein a choke is charged when the control circuitry control the switch in its conducting state and the choke is de-charged when the control circuits controls the switch in its non-conducting state, wherein by supplying an external signal or an internal feedback signal to the control circuitry, the control circuitry is designed to adapt the clocking of the switch in order to adapt the operating mode of the switched converter.

The operating mode of the driving circuit arrangement and therefore of the switching regulator can be selected of at least two of the so-called continuous conduction mode, the so-called borderline or critical mode or combination of the two operating modes.

The switched converter may be a DC/DC converter.

The switched converter may be a buck converter, a boost converter, a fly-back converter, a buck-boost converter or a switched power factor correction circuit.

The external signal may be at least one of a dimming signal, a color control signal and a color temperature signal.

The feedback signal may be at least one of a power consumption signal, a lighting means current signal or a load characteristic signal representing at least one electrical parameter of the lighting means load driven by the driving circuit.

The load characteristic signal may represent the number and/or the topology of at least two LEDs driven by the driving circuit.

The control circuitry may be an integrated circuit such as e.g. an ASIC or a microcontroller or a hybrid thereof.

A further aspect of the invention relates to a method for dimming at least one LED using a switched converter for supplying the at least one LED with electrical power, wherein the dimming selectively is performed via at least two dimming modes, including:

a first dimming modes, in which the at least one LED is dimmed by controlling the switch such that the current through the choke has an essentially triangular shape, wherein the dimming is achieved by adjusting the time period for allowing the choke current to rise to a peak value by switching on a switch of the switched converter, wherein the fall of the choke current, caused by switching off the switch of the switched converter at the peak, is stopped by switching on the switch of the switched converter at the latest when the falling choke current reaches zero, and a second dimming mode, in which, in addition or alternatively to the adjustment of the time period for allowing the current to rise to a peak value, the time period between the falling choke current reaching zero and the switching-on of the switch of the switched converter in order to cause the choke current to raise again is adjusted. The first and second dimming mode, respectively, may be selected depending on the value of a external signal or an internal feedback signal of the switched converter.

The external signal may be at least one of a dimming signal, a color control signal and a color temperature signal.

The feedback signal may be at least one of a power consumption signal, a lighting means current signal or a load characteristic signal representing at least one electrical parameter of the lighting means load driven by the driving circuit.

The invention also relates to a driving circuit for provision of an operating current for at least one LED, wherein a desired value for the operating current is specified and this is spread by a control unit temporally into at least two different operating current values of greater than zero, in such a way that the time-average value corresponds to the desired value.

The operating current behaviour may be periodic.

The driving circuit can be supplied with an external signal which the control unit evaluates and in dependence upon this to control at least one parameter of the spreading of the operating current.

The control unit may be formed to control the extent and/or the operating mode of the spread by the external signal.

The operating current may adopt discrete values.

The time duration over which a discrete value is adopted can be smaller than the temporal resolution capability of the human eye. For example, the time duration of a discrete value can be less than 1/100 s.

The operating current may vary continuously at least from time to time.

During a dead time the intensity of the operating current may be reduced to zero.

The driving circuit as claimed may comprise an input for receiving information relating to the temporal progression of the operating current.

The driving circuit may comprise an input for receiving a desired value for the average intensity of the operating current, or an input for receiving the actual value of the operating current.

The driving circuit may comprise a regulating circuit for regulating the operating current with the aid of the desired value and of the actual value of the operating current.

The progression of the operating current may be selected in such a way that the human eye is unable to perceive any flickering.

A further aspect of the invention relates to a method for improving the colour rendering index of at least one light emitting diode, wherein the current flowing through the light emitting diode has different positive intensities.

BRIEF DESCRIPTION OF THE DRAWING FIGURES

Figure 3:
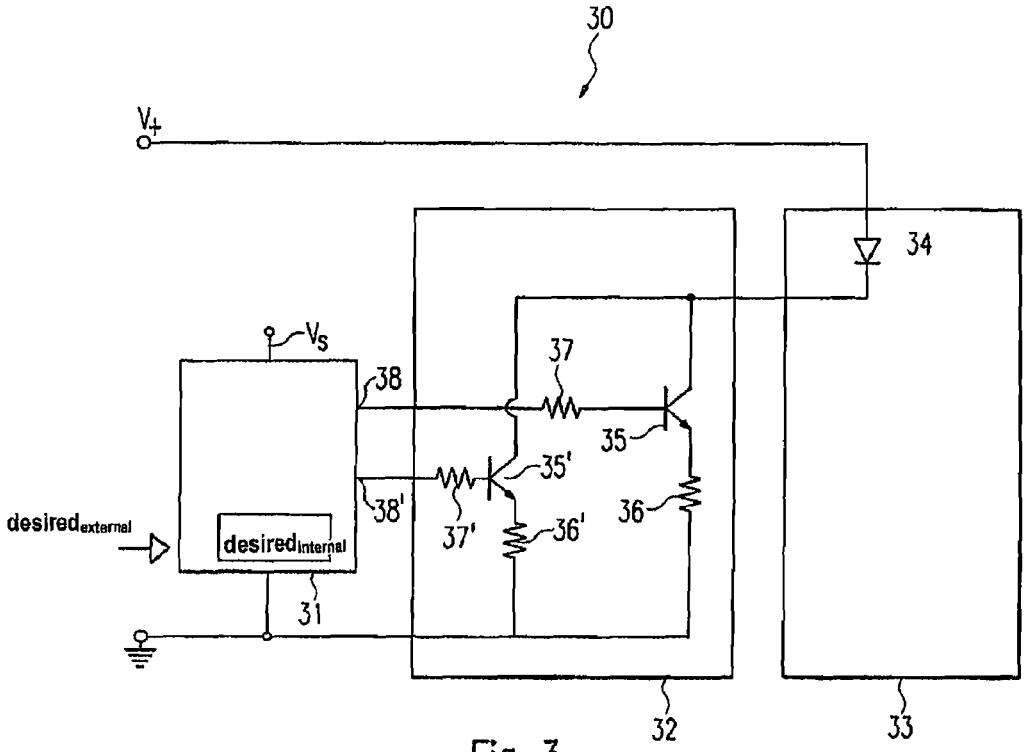
Figure 4:
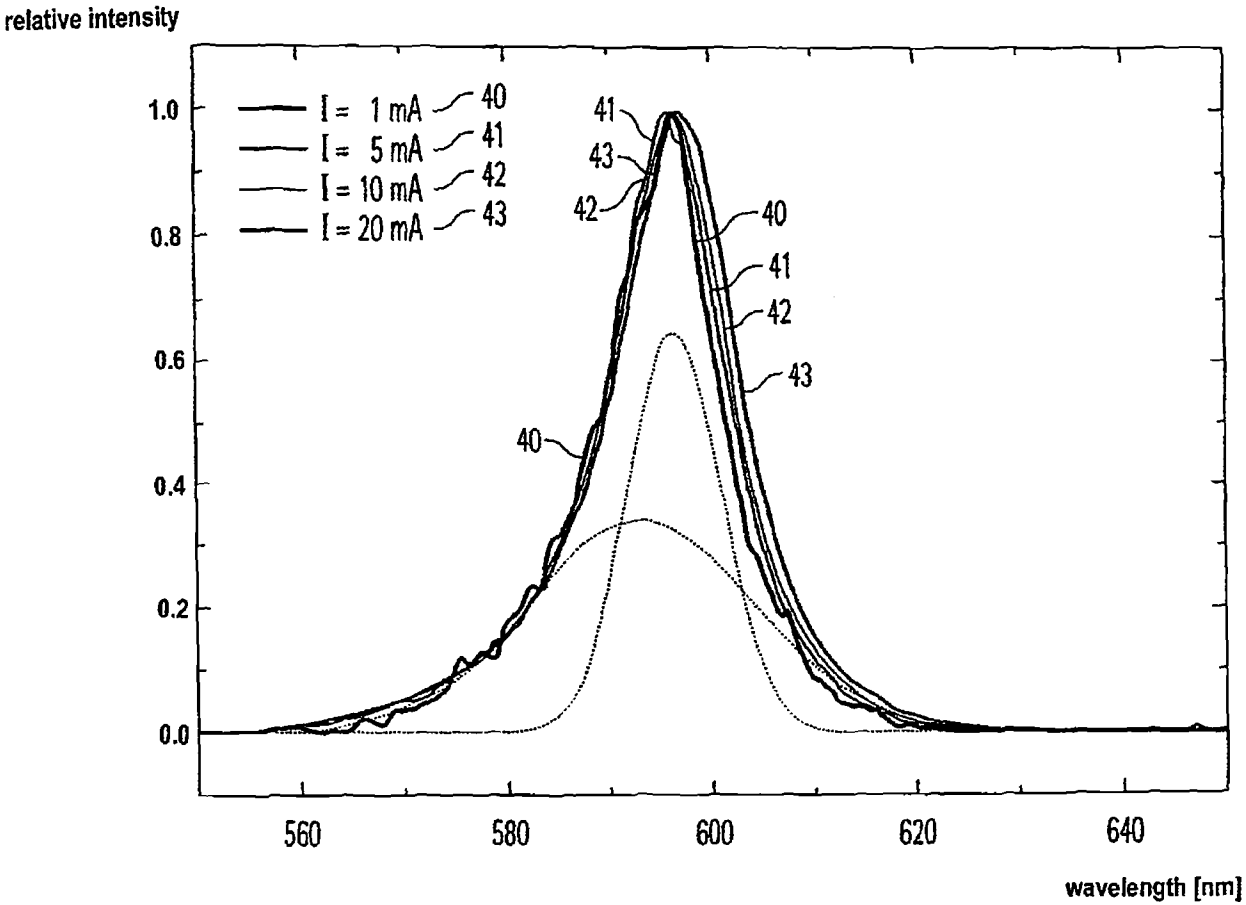
Figure 5:
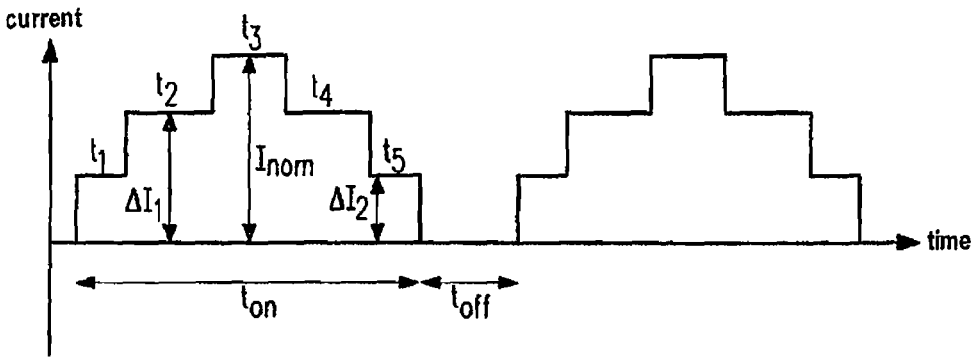
Figure 6:
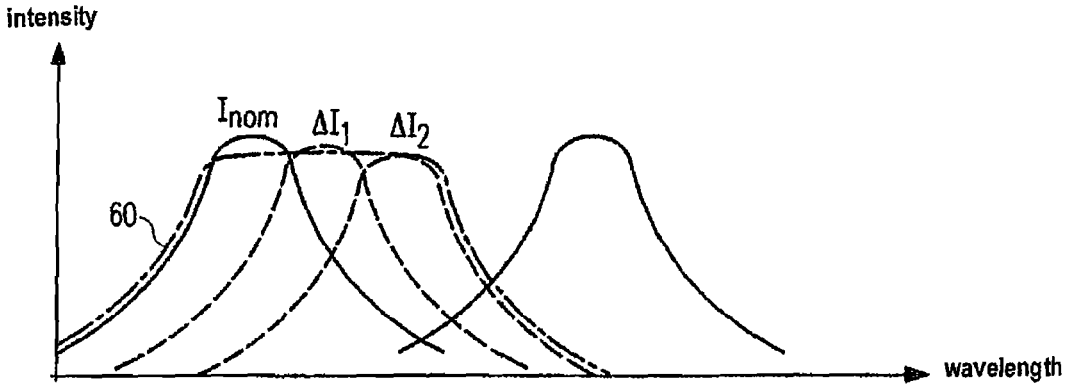
Figure 11:
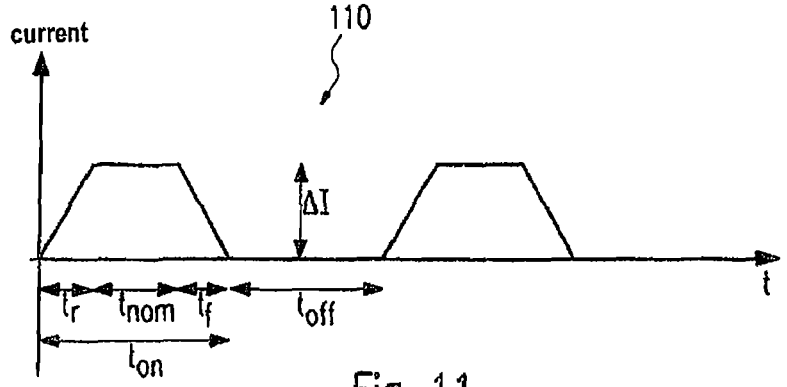
Figure 12:
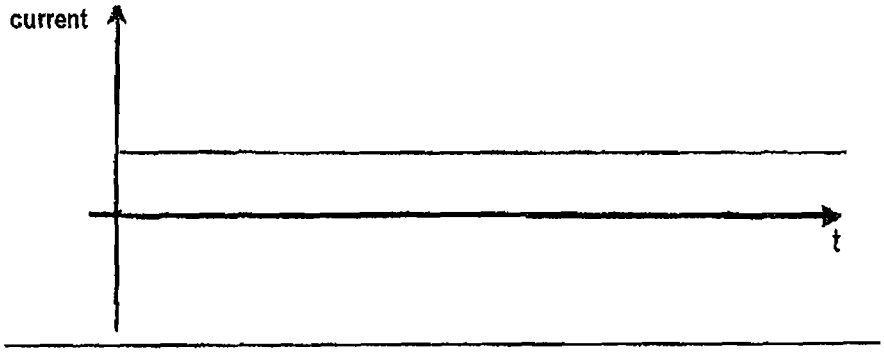
Figure 13:
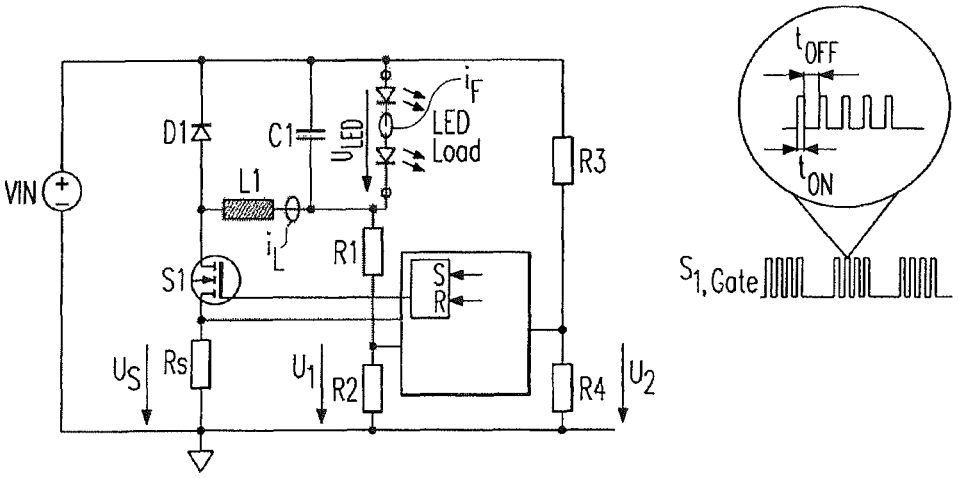
Figure 14:
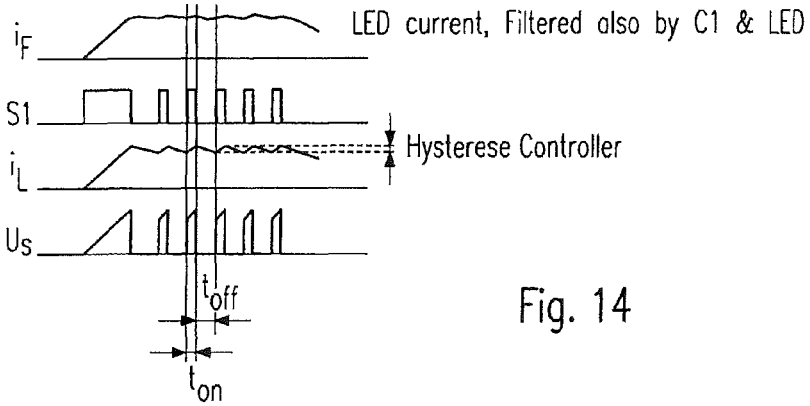
Figure 15:
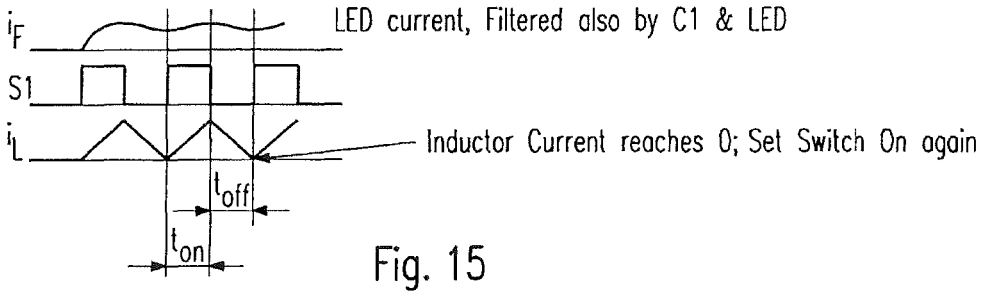
Figure 16:
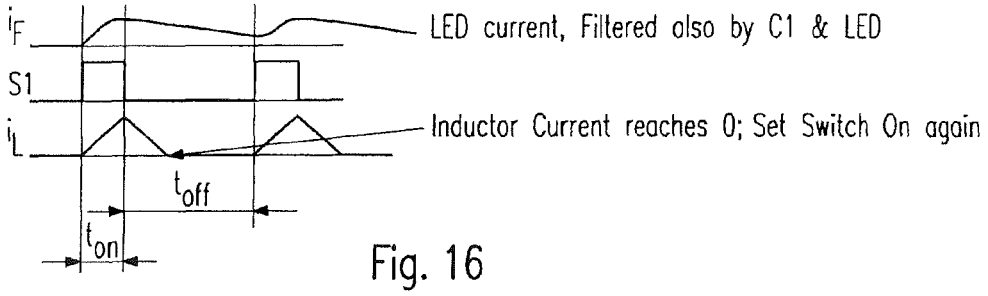
Figure 17:
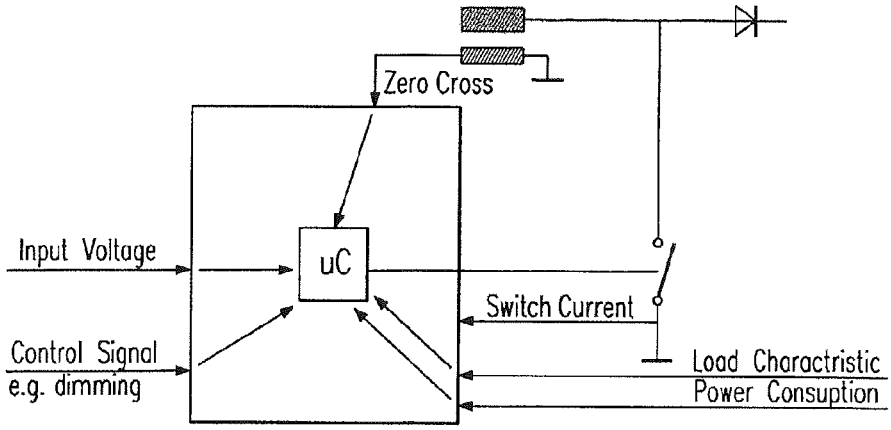
Figure 18:
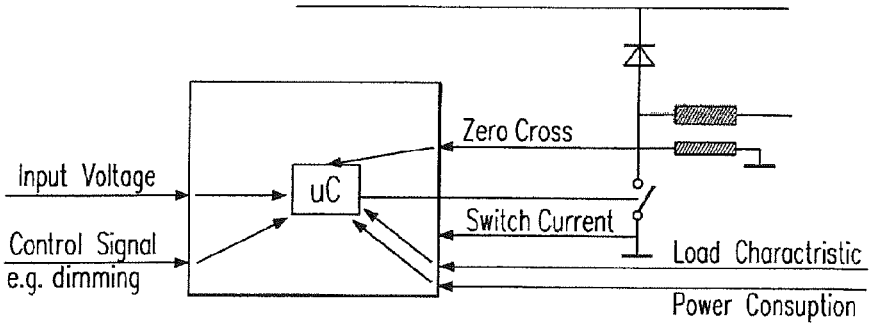

The invention will be explained in more detail hereinunder with the aid of the enclosed drawings in which:

FIG. 1 shows the spectrum of individual known one-color light emitting diodes and of a known RGB light emitting diode, FIG. 2 shows the spectrum of a known white light emitting diode produced with the aid of a color conversion layer, FIG. 3 shows an exemplified embodiment of a circuit arrangement in accordance with the present invention, FIG. 4 shows the dependency between the operating current of a light emitting diode and the spectrum of the light emitted by this light emitting diode, FIG. 5 shows an operating current in accordance with a particular embodiment of the present invention, FIG. 6 shows the different spectra which are produced with the operating current shown in FIG. 5, and the broader spectrum detected by the human eye, FIGS. 7 to 12 show alternative forms of an operating current in accordance with further embodiments of the invention, FIG. 13 shows a further exemplified embodiment of a circuit arrangement in accordance with the present invention, FIG. 14 shows signal curves for a continuous conduction mode of a switched regulator, FIG. 15 shows signal curves for a critical conduction (borderline) mode of a switched regulator, FIG. 16 shows signal curves for a discontinuous conduction mode of a switched regulator, FIG. 17 shows a switched power factor correction circuit (PFC), and FIG. 18 shows a buck converter used as a current source of one or more LEDs.

DETAILED DESCRIPTION OF THE INVENTION

FIG. 3 shows an exemplified embodiment of a circuit arrangement in accordance with the present invention.

The circuit arrangement 30 includes essentially a control circuit (driving circuit) 31, a current source 32 and a light emitting diode module 33 for one or more light emitting diodes 34.

The light emitting diode 34 is operated by the current source 32. The current source 32 has a bipolar transistor, wherein the light emitting diode 34 is connected to the collector of an NPN transistor 35. The emitter of the transistor 35 is connected to ground by means of an ohmic resistor 36. The transistor 35 is also coupled via a further ohmic resistor 37 to the control circuit 31. The control circuit 31 controls the switching on and off of the transistor 35 by means of a control connection 38.

A second transistor or switch 35' is disposed in the current source 32 in parallel with the first transistor or switch 35. The second transistor 35' is controlled in a similar manner to the first transistor 35 by a control connection 38' of the control circuit 31. The second transistor 35' is also connected to ground and to the control connection 38' by means of ohmic resistors 36', 37' respectively.

The respective NPN transistor 35, 35', which generally fulfils the function of a controllable switch, constitutes a switchable current outflow (also referred to as a "current sink"). By means of the ohmic resistors 36, 36' the diode current can be detected and can be regulated to a desired value by a change in the base voltage. In so doing, a control signal in accordance with the invention is applied to the base connection of the transistors 35, 35' in order to control the light emitting diode 34.

If only the first transistor 35 is switched on, the light emitting diode 34 is operated by a current I1. In contrast, if the first transistor 35 is switched off and only the second transistor 35' is switched on, the light emitting diode 34 is operated by a current I2. If the transistors 35, 35' are switched on at the same time an operating current I1+I2 is produced.

The light emitting diode 34 can thus be controlled by a current source 32 which can provide, for example, three different strictly positive current intensities I1, I2, I1+I2.

The control circuit (driver) 31 and the current source 32 can also be constructed differently in a known manner. In so doing, it is important for at least two positive current amplitudes for operating the light emitting diode to be provided by the current source 32.

The control circuit 31 can be supplied externally and/or internally with desired values which specify the time-averaged desired current through the light emitting diodes. The control circuit spreads this desired value into at least two different values greater than zero, which are implemented one after the other, wherein the time-average again corresponds to the specified desired value.

The control circuit can be supplied with a color locus correction command. This color locus correction command can selectively trigger the amplitude spread and can possibly also specify the extent of the amplitude spread. The color locus correction command therefore provides an adaptation of the spectrum.

In dependence upon the color locus correction command the control circuit can then, e.g. by means of previously stored values (look-up tables) or by means of an implemented function, determine and output the associated amplitude values to the color locus correction command, which are then implemented one after the other. Alternatively or additionally the control circuit can impose an operating mode (continuous vs. discrete) for the amplitude spread in dependence upon the color locus correction command.

Alternative current sources and control circuits in accordance with the invention are able to provide a temporally varying and continuous operating current. Current sources of this type, which produce a continuous operating current only partially in specific time segments, are naturally also included.

The current which flows through the light emitting diode or light emitting diodes can also be detected and regulated to a specified desired value. This desired value can also be selected in such a way that the light emitting diodes are operated to a maximum possible degree of efficiency.

In order to control or regulate the current for the light emitting diode 34 the transistors or switches 35, 35' are connected to the control connections 38, 38' of the control circuit 31.

The operating current of the light emitting diode or the forward current is formed in such a way that it operates the light emitting diode 34 at a different intensity. This deliberately exploits the fact that the color spectrum of a light emitting diode is dependent on the current with which it is operated.

FIG. 4 shows a dependency of this type between the operating current of a light emitting diode and the spectrum of the light emitted by this light emitting diode. In the case of different values for the operating current or the forward current, different distributions of the spectrum also result, see in particular the curves 40, 41, 42, 43 in the case of a respective operating current of 1, 5, 10 and 20 mA.

The invention now proposes operating the light emitting diode with different intensities one after the other. In the example of FIG. 4 the light emitting diode can thus [lacuna] e.g. one after the other with 1, 5, 10 and 20 mA.

Since the respective spectra are different or shifted in the frequency range there is, as an average value, a spectrum which is broader than the individual spectra 40, 41, 42, 43 or which has smaller troughs than the individual spectra 40, 41, 42, 43. The color rendering index can therefore also be increased.

FIG. 5 shows a specific example of an operating current or forward current 50 produced by the current source 32 for the light emitting diode 34. The multi-step operating current 50 has a certain time period $T=(t_{on}+t_{off})$, wherein during the time duration $t_{on}$ the operating current 50 takes on different positive intensity values. In the time duration $t_{off}$, which does not necessarily have to be provided, the value of the operating current 50 is reduced to zero.

In the time duration $t_{on}$ the operating current 50 successively takes on the value ΔI2, ΔI1, Inom, ΔI1 and ΔI2 over a respective time t1, t2, t3, t4 and t5. In this exemplified embodiment an average current intensity of $$Im=[(t1+t5)\cdot\Delta I2+(t2+t4)\cdot\Delta I1+t3\cdot Inom]/[t_{on}+t_{off}]$$

is thereby achieved.

For dimming purposes the pulse duty ratio of the operating current 50 can additionally be changed. Alternatively the time duration $t_{off}$ can also be reduced or increased or even omitted.

FIG. 6 shows the different spectra which can be achieved with the operating intensities Inom, ΔI1 and ΔI2. As the current intensity falls the spectrum produced by the light emitting diode is constantly shifted to higher wavelengths.

The change in intensity preferably takes place more rapidly than the temporal resolution capability of the human eye so that the eye perceives only the time-average value of the emitted light. Consequently the frequency with which the operating current 50 is varied should be above 100 Hz. Accordingly the respective time duration t1, t2, t3, t4, t5 should be less than 1/100 s long.

The spectrum 60 perceived by the eye is thus broader than the spectrum which is produced during operation with the nominal intensity Inom.

FIGS. 7 to 12 show alternative forms of the operating current or forward current for the light emitting diode in accordance with further embodiments of the invention.

The operating currents shown in FIGS. 7 to 11 are preferably periodic and preferably have a time duration $t_{off}$ during which the intensity is equal to zero.

Figure 7:
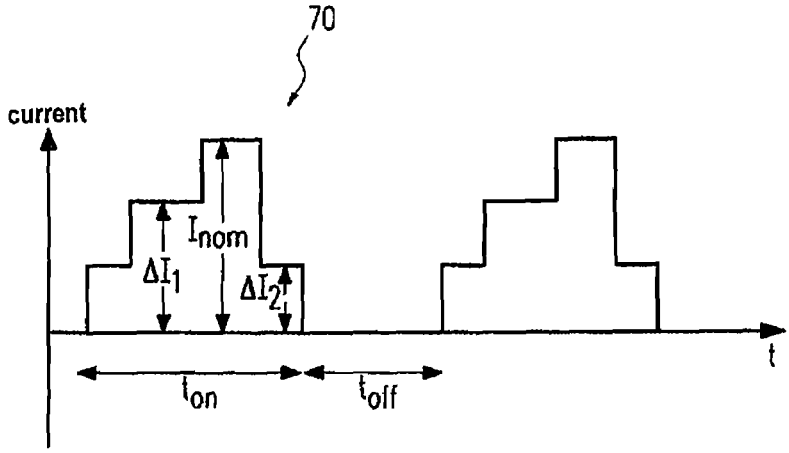

The operating currents 50, 70 in accordance with FIGS. 5 and 7 can adopt different individual values, i.e. different discrete values: 0, ΔI1, ΔI2 or Inom. It is thus important that the light emitting diode is operated at least with two different strictly positive intensities such as ΔI1 and Inom. The spectrum of the emitted light can in this way be distributed.

However, FIGS. 8 to 11 show operating currents 80, 90, 100, 110 in accordance with the invention which have a continuous intensity. The intensity varies between zero and a maximum strictly positive value ΔI. The light emitting diode is thus naturally operated at more than two different positive current intensities.

Figure 9:
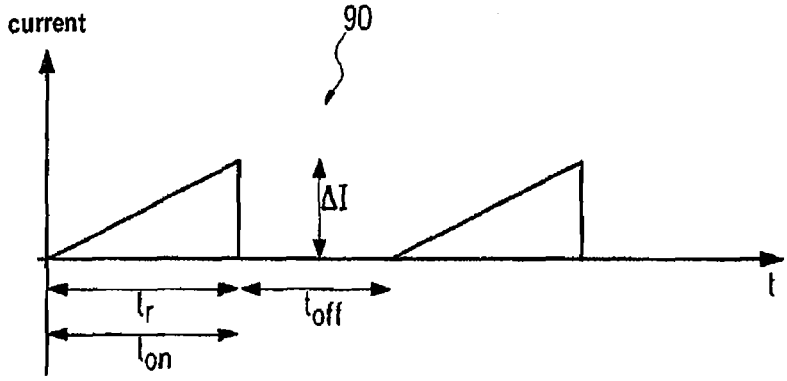

In FIG. 9 an operating current 90 is shown which in a first phase $tr=t_{on}$ increases from zero to a maximum value ΔI and in a second phase $t_{off}$ adopts a zero value.

The color rendering index of light emitting diodes is therefore increased. This effect is produced, for example, in the case of the operating current 100 of FIG. 10. The light emitting diode is therefore operated in the so-called borderline or critical mode, i.e. with control operations in which the operating current or light emitting diode current increases in a substantially triangular manner to a maximum value ΔI and then falls to zero in order to rise again immediately.

Figure 10:
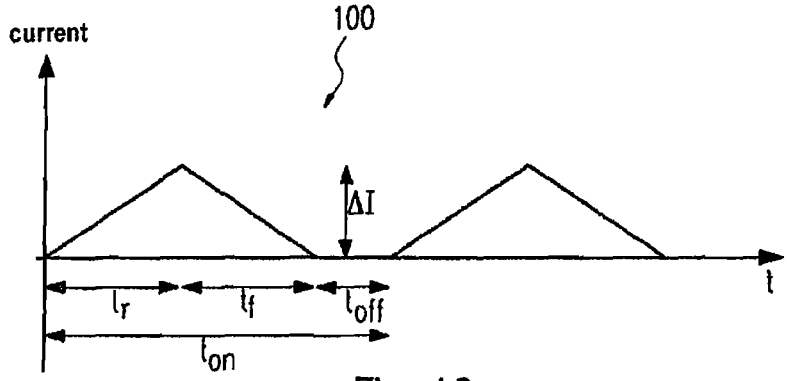

The operating mode in accordance with FIG. 10 ensures a high level of spreading and therefore a high level of color correction. The reason for this is that with this operating mode the maximum value of the current is double the time-average value. From time to time the LED can thus be operated with double the LED manufacturer's specified nominal value for continuous operation.

Ideally the time duration $t_{off}$ is close to zero so that there is no range in which no energy is transmitted. However, by reason of the technical implementation, the necessary recognition of the zero point being reached, and by means of the switching times of the control operation, there may be a certain unintentional time duration $t_{off}$ of greater than zero.

In a similar manner to the operating current 100, the operating current 110 shown in FIG. 11 has a rising phase from zero to a maximum value ΔI during the time duration tr and a falling phase from this maximum value ΔI to zero in a time period tf. Therebetween, however, the operating current 110 is kept constant at the maximum value ΔI during a time duration tnom.

Figure 8:
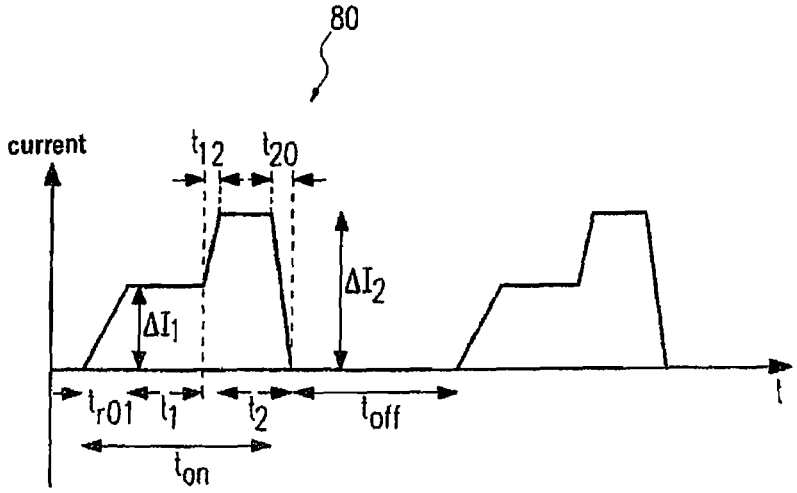

As shown in FIG. 8 operating currents or forward currents 80 are also feasible, which, in a period ($t_{on}$+$t_{off}$), have a plurality of rising and/or falling phases. In the case where the light emitting diode is controlled in accordance with FIG. 8 the current is kept constant at ΔI1 during a time duration t1 between two rising phases tr01, t12. After the second rising phase t12 the current remains at the maximum value ΔI2 during the time duration t2 and falls linearly to zero.

However, as shown in FIG. 12, the operating current or forward current 120 can also be selected in such a way that an almost constant amplitude for the current is set. In this way ΔI is reduced to a minimum. The light emitting diode 34 is thus operated with only a single-step current level. In this case the light emitting diode 34 would be operated with the LED manufacturer's specified nominal value for continuous operation.

Provision is thus made for a light emitting diode 34 to be operated with current in such a way that the spectrum of the light emitted by this light emitting diode 34 can be distributed or has smaller troughs.

In the case of a single-color light emitting diode, e.g. blue, green, yellow or red, the relative intensity of the spectrum can be increased with respect to the maximum intensity.

FIG. 13 shows a further exemplified embodiment of a circuit arrangement 130 for controlling the light emitting diode 34 in accordance with the invention. The circuit arrangement 130 has a switching regulator which is formed by the choke L1, the capacitor C1, the free-wheeling diode D1, the switch S1 and the light emitting diodes 34. In this example the switching regulator is formed as a buck converter, however, other topologies such as a boost converter (see FIG. 17), a flyback converter or even a buck-boost converter can also be used. A plurality of resistors ("shunts") is provided in order to monitor the currents and voltages in the switching regulator and at the light emitting diodes 34. The resistor Rs thus serves to monitor the current through the switch S1 during the switch-on period of the switch S1, wherein the current is represented by the voltage $U_s$ across the shunt $R_s$.

The current $i_F$ flows through the load, i.e. the LEDs.

The current $i_L$ flows through the choke L1.

The two voltage dividers R3/R4 and R1/R2 serve to monitor the voltage $U_{LED}$ across the light emitting diodes 34. However, in an alternative embodiment the light emitting diodes 34 can also be connected in series with the choke L1. The switch S1 of the switching regulator is controlled by the control circuit IC. The control circuit IC can be supplied externally and/or internally with desired values which specify the time-averaged desired current through the light emitting diodes. The control circuit spreads this desired value into at least two different values of greater than zero, which are implemented one after the other, wherein the time-average again corresponds to the specified desired value.

The control circuit IC can be supplied with a colour locus correction command as an external desired value. This colour locus correction command can selectively trigger the amplitude spread and possibly also specify the extent of the amplitude spread. The colour locus correction command therefore specifies an adaptation of the spectrum.

The circuit arrangement 130 is an advantageous embodiment to achieve control of the light emitting diodes 34 in accordance with the invention with the smallest possible losses.

During operation of the light emitting diodes 34 with almost constant amplitude, at least for a certain time duration of the time period T, it is possible to cause the circuit arrangement 130 to be operated in the so-called continuous conduction mode. The circuit arrangement 130 is controlled in such a way that the current $i_L$ through the choke L1 never falls to zero but maintains a value which is constant on average. In order to achieve such operation, the choke L1 is magnetised in a first phase by switching on the switch S1. The current $i_L$ through the choke L1 can be monitored in this phase by means of the resistor Rs. If a certain current value (upper limit value) is achieved, the switch S1 is opened. Owing to the magnetisation of the choke L1 the current $i_L$ is now driven further through the free-wheeling diode D1 and the light emitting diodes 34. The current $i_L$ through the choke L1 thus slowly falls. Owing to the flow of current through the free-wheeling diode D1 and the light emitting diodes 34 the capacitor C1 is also charged. The reduction in the demagnetisation and in the current $i_L$ through the choke L1 can be monitored by the two voltage dividers R3/R4 and R1/R2. If the current $i_L$ reaches a certain lower limit value, the switch S1 is switched on and the choke L1 is magnetised. While the free-wheeling diode D1 now blocks the current flow, the capacitor C1 is discharged via the light emitting diodes 34. The circuit arrangement 130 is thus operated in the high-frequency range.

By appropriate selection of the two limit values for the maximum and minimum choke current $i_L$ and therefore of the current through the light emitting diodes 34, the amplitude spread of the current can be set by the light emitting diodes 34. Where the choice of the two limit values is correspondingly narrow the current will appear almost constant for the observer. For the example in accordance with FIG. 5 it is possible, for the respective times t1, t2, t3, t4 and t5 by setting the two limit values, to set the current to the value ΔI2, ΔI1, Inom, ΔI1 and ΔI2 respectively one after the other.

During operation in accordance with FIG. 12, only the nominal current is set by 0.2 narrow limit values just above or below this nominal current.

The circuit arrangement 130, however, can also be operated in the so-called borderline or critical mode. This operation produces an operating current 100 in accordance with FIG. 10. The choke L1 is magnetised, starting from complete demagnetisation, by closing the switch S1 until the maximum value ΔI has been achieved. The switch S1 is now opened and the choke L1 demagnetised, which leads to a fall in the operating current. By means of a measurement at the two voltage dividers R3/R4 and R1/R2 or at least at the voltage divider R1/R2 the time when the zero point of the operating current is achieved can be determined. As soon as it is detected (or it can be deduced), by means of a direct or indirect measurement variable, that the zero point of the operating current has been reached, the switch S1 can be closed and the choke L1 can be magnetised.

The circuit arrangement 130 can, for example, also be operated in an operating mode in accordance with FIG. 11. The choke L1 is magnetised, starting from complete demagnetisation, by closing the switch S1 until the maximum value ΔI has been achieved. The switch S1 is now opened and the choke L1 is demagnetised but only until an internally set lower limit value just below the maximum value ΔI is achieved. If this value has been achieved, the switch S1 is switched on. The circuit arrangement 130 is now operated in a so-called continuous conduction mode until the time duration Tnom has elapsed. Now, during the time duration tf the switch S1 is permanently open and the choke L1 is demagnetised, which leads to a fall in the operating current. By means of a measurement at the two voltage dividers R3/R4 and R1/R2 or at least at the voltage divider R1/R2 the time when the zero point of the operating current is reached can be determined. As soon as the reaching of the zero point of the operating current has been detected or the time duration $t_{off}$ has elapsed, the switch S1 can be closed and the choke L1 can be magnetised. In this operating mode the switch S1 has two different switching frequencies, during the time duration Tnom it is controlled with a higher clock frequency in comparison to the time durations Tr, Tf and $T_{off}$.

Thus by supplying an external signal such as, for example, a colour locus correction command, the operating mode of the circuit arrangement 130 and therefore of the switching regulator can be selected and adapted. Operation in the so-called continuous conduction mode, in the so-called borderline or critical mode or even a combination of the two operating modes can be selected for example. This aspect of the invention will be further explained later on with reference to FIGS. 14 to 18.

FIG. 2 shows the effect of the invention during control of a white light emitting diode with a phosphorous layer with the aid of a forward current in accordance with FIG. 5. The white light emitting diode is accordingly operated with different strictly positive current intensities, namely ΔI1, ΔI2 and Inom.

The curves 11, 12, 13 designate the spectra of the while light emitting diodes during operation with the respective intensities Inom, ΔI2 and ΔI1. As intensity decreases, the spectrum shifts towards higher wavelengths.

The white light emitting diode is operated with the different intensities one after the other. Over a period ($t_{on}$+$t_{off}$) a spectrum 14 is then produced which is broader as a whole than the respective spectra 11, 12, 13. Thus the adjacent troughs 16, 17 can be reduced. It is also important that it was also possible clearly to reduce the spectral trough 15 between the blue spectrum 8 and the converted yellow spectrum 9.

It is also possible to control a plurality of light emitting diodes with a current source 32 in accordance with the invention or with an operating current in accordance with the invention.

A plurality of light emitting diodes can also be controlled in parallel by different operating currents in accordance with the invention.

With reference to FIGS. 13 to 18 it will now be explained how, according to an aspect of the invention, a switched converter (buck converter, boost converter, PFC converter, flyback converter, etc.) selectively operates in at least two different operation modes, which different operation modes e.g. can be different dimming modes.

The different dimming modes can e.g. be used to have a first dimming range up to a defined threshold value, and a second dimming range in which the switch converter is in a different operation mode than in the first dimming range.

FIG. 14 shows different signal curves when a switched converter is operated in the so-called continuous conduction mode CCM.

As can be seen from FIG. 14, in the continuous conduction mode, when a control circuitry switches on the switch S1, which can be seen from the depicted gate signal in FIG. 14, both the current through the diode $I_F$ as well as the diode through the magnetizing choke L1 will increase. Also the voltage US across the shunt RS increases essentially linearly, representing the increasing current through the switch S1.

As soon as e.g. the current through the choke EL or the current through the switch reaches an upper threshold value, the control circuitry switches off the switch S1. After this switching off at the peak of the choke $i_L$, the choke L1 linearly demagnetizes which can be seen from the linearly falling choke current $I_L$. As soon as the choke current reaches a lower threshold value, the lower threshold being larger than zero, the switch S1 is switched on again leading to the shown hysteresis controller behaviour of FIG. 14.

Note that the current through the load (LEDs) is not exactly following the choke current as the storage capacitor C1 has a filtering effect.

The power supplied to the LED load is a function of the time average value of the choke current. Obviously, by increasing the time period $T_{off}$ during which the switch is in the non-conducting state, the average value of the choke current $i_L$ can be reduced, leading to a downwards dimming (reduced power) of the LED load.

FIG. 15 shows the so-called borderline or critical conduction mode, in which the non-conducting period of the switch S1, the time period $T_{off}$ as well as the switching-on time period $T_{on}$ have been increased such that the current $i_L$ is allowed to drop to zero during the non-conducting time period $T_{off}$, the switch S1 is switched on (put in the conducting state) by the control circuitry as soon as it has reached the zero value.

FIG. 16 now shows a third operation mode for a switch converter, the so-called discontinuous conduction mode. In comparison to FIG. 15 the choke current $i_L$ is again be allowed to drop to zero. However, the switch S1 is not immediately switched on upon the choke current $i_L$ reaching the zero value. Rather, the non conducting time period $T_{off}$ is extended such that there is a non zero time period during which the choke current $I_L$ remains at zero. In this operation mode a dimming can be achieved e.g. by increasing the $T_{off}$ value and thus the time period in which the choke current $I_L$ is zero.

FIG. 17 shows an actively switched power factor correction circuit PFC.

The power circuitry is depicted as a micro controller μc, although e.g. also an ASIC or a hybrid version of a microcontroller and an ASIC can be used.

Internal feedback signals from the switched controller can be fed back to the control circuitry. Typical examples are the sensed input voltage of the switched converter, a zero crossing detection signal for detecting the zero crossing of the choke current $I_L$, a signal indicating the current through the switch S1 and furthermore, feedback signals from the load such as e.g. the lighting means (LED) voltage, the lighting means (LED) current and the load characteristics, i.e. a signal indicating e.g. the number and the topology of several connected LEDs driven as a load.

Also external control signals, such as e.g. dimming signals can be fed to the microcontroller.

According to one aspect of the invention, the control circuitry as shown in FIG. 17 or 18 for a switched lighting means converter can operate selectively in different operation modes, i.e. the continuous conduction mode of FIG. 14, the borderline (critical) conduction mode of FIG. 15 or the discontinuous conduction mode of FIG. 16.

The control circuitry will select the best-suited operation mode according to any of the internal and/or external feedback signals, examples of which are given above.

FIG. 18 shows a buck converter used as a current source of one or more LEDs driven as a load. Again, different internal feedback signals (e.g. input or supply voltage, zero crossing detection, switch current, load characteristic, power consumption representing parameters) and external signals (e.g. external dimming control signals) can be fed to the depicted control circuitry.

The adaptive setting of the operation mode of the switched lighting means converter according to the invention has several advantages, which will be explained now.

Advantage is that without changing the dimensions of the hardware elements, such as for example the choke L1 and the storage capacitor C1, varying loads, such as for example different topologies or different numbers of driven LEDs can be operated by the switched conducting means converter, all by having reasonable switching times and frequencies for the choke current $i_L$ and thus the LED current.

Just as an illustrative example, the choke L1 with a maximum allowed current of 0.55 A can be used in the continuous conduction mode (CCM) for a LED current $i_F$ up to 500 mA (average value), wherein the Ton-time period duration for the switch S1 primarily depends on the amplitude (RMS value) of the supply voltage $V_{in}$ and the voltage across the LEDs $U_{LED}$. If now it is desired to reduce the average value of the LED current $i_F$, obviously the Ton-time period has to be reduced, especially when also $U_{LED}$ is small. This reduction of Ton-time period for the switch S1 will thus lead to very high switching frequencies. The choke current will eventually drop to zero, which corresponds to a dimming of the LEDs, in which the LED current $I_F$ time average basis is only 50% of the allowed maximum LED current $I_F$. Thus, this illustrative example the dimming value of 50% leads to a change of the previous continuous conduction mode to the borderline mode.

According to the invention, if the feedback signals or the external signals (dimming signals) require a further dimming e.g. going below of the 50% value, according to the invention the switched converter will change from the borderline conduction mode to the discontinuous conduction mode depicted in FIG. 16. In order to further reduce the power supplied to the LEDs, the $T_{off}$ time period will be further increased in order to further reduce the average LED current $i_F$ all by having a T-on time period is not too small, i.e. below a certain lower threshold value representing the minimum value possible e.g. with the clocking of the control circuitry.

Thus, according to the invention the control circuitry will use an operation mode for the switched lighting means converter depending on the load, the current requirements of the load etc. in order to have a flexible use of the same hardware for different scenarios and for a wide dimming range.

As explained in FIG. 17, the switched converter may be a switched PFC, which generates, as a first conversion stage, a DC voltage typically out of a rectified AC voltage, such as e.g. mains voltage. As second converter stage may be provided, which may be a DC/DC or DC/AC (e.g. half bridge or full bridge converter) stage supplying the lighting means and optionally also selectively operating in different operation modes, depending on external signal and/or internal feedback signal.

What is claimed is:

1. A driving circuit for provision of an operating current for at least one light emitting means, the driving circuit comprising:

a switched converter having a switch controlled by a control circuitry having a plurality of operating modes, wherein a choke is charged when the control circuitry controls the switch in a conducting state and the choke is discharged when the control circuitry controls the switch in a non-conducting state, wherein by supplying an external signal or an internal feedback signal to the control circuitry, the control circuitry is configured to adapt clocking of the switch to select the operating mode of the switched converter.

2. The driving circuit according to claim 1, wherein the operating mode of the driving circuit arrangement and the switching regulator is selected in at least two of the following modes: a continuous conduction mode, a borderline or critical mode, or a combination of the two operating modes.

3. The driving circuit according to claim 1, wherein the light emitting means is a light emitting diode (LED), and the switched converter is a DC/DC converter.

4. The driving circuit according to claim 1, wherein the switched converter is a buck converter, a boost converter, a fly-back converter, a buck-boost converter or a switched power factor correction circuit.

5. The driving circuit according to claim 1, wherein the external signal is at least one of a dimming signal, a color control signal and a color temperature signal.

6. The driving circuit according to claim 1, wherein the feedback signal is at least one of a power consumption signal, a lighting means current signal or a load characteristic signal representing at least one electrical parameter of the load driven by the driving circuit.

7. The driving circuit according to claim 6, wherein the load characteristic signal represents the number and/or the topology of at least two LEDs driven by the driving circuit.

8. Driving circuit according to claim 1, wherein the control circuitry is an integrated circuit, an ASIC, a microcontroller or a hybrid thereof.

9. The driving circuit according to claim 1, which supplies electrical power to the at least one LED or to a further DC/DC or DC/AC converter stage.

10. A method for dimming at least one light emitting diode (LED) using a switched converter for supplying the at least one LED with electrical power, the switched converter comprising a switch for charging a choke when the switch is conducting and discharging the choke when the switch is non-conducting, which comprises performing the dimming selectively via at least two dimming modes, including:

(1) a first dimming mode, in which the at least one LED is dimmed by controlling the switch such that the current through the choke has an essentially triangular shape, wherein the dimming is achieved by adjusting the time period for allowing the choke current to rise to a peak value by switching on a switch of the switched converter, and wherein the fall of the choke current, caused by switching off the switch of the switched converter at the peak, is stopped by switching on the switch of the switched converter at the latest when the falling choke current reaches zero, and (2) a second dimming mode, wherein, in addition or alternatively to the adjustment of the time period for allowing the current to rise to a peak value, the dimming is achieved by adjusting the time period between the falling choke current reaching zero and the switching-on of the switch of the switched converter in order to cause the choke current to raise again.

11. The method according to claim 10, wherein the first and second dimming modes, respectively, are selected depending on the value of a external signal or an internal feedback signal of the switched converter.

12. The method according to claim 11, wherein the external signal is at least one of a dimming signal, a color control signal and a color temperature signal.

13. The method according to claim 11, wherein the feedback signal is at least one of a power consumption signal, a lighting means current signal or a load characteristic signal representing at least one electrical parameter of the lighting means load driven by the driving circuit.

14. A driving circuit for provision of an operating current for at least one light emitting diode (LED), wherein a desired value for the operating current is specified and spread by a control unit temporally into at least two different operating current values of greater than zero, in such a way that the time-average value corresponds to the desired value, wherein the driving circuit is configured to determine the amplitude values for the at least two different operating current values depending on a supplied color locus correction command.

15. A device for operating at least one light emitting diode, comprising a driving circuit as claimed in claim 1.

16. A device for operating at least one light emitting diode, comprising a driving circuit as claimed in claim 14.

17. A method for improving the color rendering index of a light emitting means, which comprises providing time-varying operating current flowing through the light emitting means with different positive intensities, wherein the time-varying operating current is provided by the driving circuit of claim 1.

18. A method for improving the color rendering index of a light emitting diode (LED), which comprises providing time-varying operating current flowing through the LED with different positive intensities, wherein the time-varying operating current is provided by the driving circuit of claim 14.

* * * * *